United States Patent [19]

Pastryk et al.

[11] Patent Number: 4,986,093

[45] Date of Patent: Jan. 22, 1991

[54] FLUID RECIRCULATION SYSTEM FOR AN AUTOMATIC WASHER

[75] Inventors: Jim J. Pastryk, Weesaw Township, Berrien County; Nihat O. Cur, St. Joseph Township, Berrien County; Anthony H. Hardaway, Lincoln Township, Berrien County; John W. Euler, St. Joseph, Berrien County, all of Mich.

[73] Assignee: Whirlpool Corporation, Benton Harbor, Mich.

[21] Appl. No.: 461,410

[22] Filed: Jan. 5, 1990

[51] Int. Cl.[5] ..... D06F 39/02; D06F 39/08

[52] U.S. Cl. ..... 68/13 R; 68/17 R; 68/208

[58] Field of Search ..... 68/13 R, 17 R, 18 D, 68/23.5, 53, 148, 174, 184, 208

[56] References Cited

U.S. PATENT DOCUMENTS

| | | | |
|---|---|---|---|
| 2,554,672 | 5/1951 | Johnston | 68/23.5 |
| 3,035,431 | 5/1962 | Smith et al. | 68/17 R X |
| 3,088,304 | 5/1963 | Bochan | 68/17 R X |
| 4,338,802 | 7/1982 | Ohmann et al. . | |
| 4,357,813 | 11/1982 | Sherer et al. . | |
| 4,402,198 | 9/1983 | Cartier . | |
| 4,417,457 | 11/1983 | Brenner . | |
| 4,419,870 | 12/1983 | Brenner . | |
| 4,420,951 | 12/1983 | Clearman et al. . | |
| 4,420,952 | 12/1983 | Brenner et al. . | |
| 4,503,575 | 3/1985 | Knoop et al. . | |
| 4,697,293 | 10/1987 | Knoop . | |
| 4,754,622 | 7/1988 | Fanson . | |
| 4,784,666 | 11/1988 | Brenner et al. . | |

*Primary Examiner*—Philip R. Coe

*Attorney, Agent, or Firm*—Hill, Van Santen, Steadman & Simpson

[57] ABSTRACT

An automatic washer having an improved recirculation system wherein wash liquid is collected in a sump and recirculated onto the clothes load in a first recirculation loop and wash liquid is recirculated from a mixing tank through conduits and a pump back to the mixing tank to effect thorough mixing of the wash liquid. The mixing tank can be selectively connected to the first recirculation loop to direct selected amounts of wash fluid into the wash load, and a sensor is provided to sense the amount of wash fluid in the sump to assure that a sufficient amount of wash fluid is being recirculated into the clothes load.

15 Claims, 7 Drawing Sheets

FLUID RECIRCULATION SYSTEM FOR AN AUTOMATIC WASHER

BACKGROUND OF THE INVENTION

The present invention relates to automatic washers, and more particularly to an improved fluid recirculation system for an automatic washer.

Vertical axis automatic washers generally include fluid handling systems for filling a washer tub with a wash fluid (generally a water and detergent solution) and then after an agitation portion of the cycle, draining the wash fluid from the tub. A subsequent rinse with fresh water and draining of the rinse water are also provided. During the agitate portion of the wash cycle, oftentimes the agitator provides a pumping action causing the wash fluid to be recirculated through the wash tub, sometimes through filter elements, such as disclosed in U.S. Pat. Nos. 4,338,802; 4,357,813; 4,402,198; 4,417,457; 4,419,870; 4,420,951 and 4,420,952, all assigned to the assignee of the present application. The recirculation of wash liquid by the above listed patents generally occurs during the agitate portion of the wash cycle and involves recirculating the wash liquid within the wash tub, and oftentimes through or along a portion of the agitator body.

U.S. Pat. No. 4,784,666, assigned to the assignee of the present application, discloses a high performance washing process for vertical axis automatic washers which includes the recirculation of wash fluid prior to the agitate portion of the wash cycle. That patent describes, as a particular embodiment of the invention, to load a charge of detergent into the washer along with a predetermined amount of water, preferably prior to admitting a clothes load into the basket to assure that the concentrated detergent solution will initially be held in a sump area of the wash tub so that the detergent will be completely dissolved or mixed into a uniform solution before being applied to the clothes load. It is also suggested that the addition of an anti foaming agent may be desireable. No particular arrangement is provided for mixing the detergent and water to provide a uniform solution, nor is any particular means described for assuring that the amount of wash liquid within the tub during the spin wash portion of the wash cycle is an amount which is slightly in excess of the saturation level for the clothes load.

U.S. Pat. No. 4,503,575, assigned to the assignee of the present application, discloses the use of an additive mixing tank and a recirculation system for directing wash liquid into the mixing tank at selected portions of the wash cycle and for admitting selected additives to the wash liquid within the mixing tank prior to dispensing such additives into the wash tub.

SUMMARY OF THE INvENTION

The present invention provides for an improved fluid recirculation system which is particularly useful in performing a concentrated detergent solution spin wash portion of a wash cycle. The recirculation system includes a mixing tank for receiving the initial charge of detergent and initial charge of water to be mixed therewith and also includes a recirculating circuit to assure thorough mixing of the water and detergent prior to a portion of the wash cycle wherein the concentrated detergent is sprayed onto the spinning clothes load. The recirculation system also provides for a collection area, such as a sump for collecting excess concentrated detergent solution during the spin wash cycle to keep it spaced away from the spinning wash basket to prevent an over sudsing situation and also liquid level sensing means are provided to maintain the level of wash liquid in the collection zone at a desired level, again so as to prevent an over sudsing situation, and also to ensure that a sufficient amount of wash liquid is provided to be continuously reapplied to the spinning wash load. The recirculating system includes means for back flushing the system to remove all remaining concentrated detergent solution upon the conclusion of the agitate portion of the wash cycle.

By providing the mixing tank, which is positioned so as to receive detergent directly from a detergent dispenser, the user of the washer may place the clothes load within the wash basket, place the detergent in the detergent dispenser, make the appropriate cycle, fabric and temperature selections and then walk away. The entire wash cycle can then be conducted automatically by the washer. The user does not have to first load the detergent into the wash zone, admit water and wait until the detergent and water have thoroughly mixed in solution prior to adding the wash load. Further, by use of the mixing tank and the metering and sensing apparatus, the detergent can be thoroughly dissolved into the water by recirculation of the wash liquid from the mixing tank, through the pump and back to the mixing tank. Also, the washer can automatically add the precise amount of concentrated detergent solution to the spinning wash load thereby preventing an over sudsing condition and assuring continuous flow of concentrated detergent solution onto the spinning wash load. Such a system can also accommodate changes to the wash load mid-cycle during the spin wash portion of the wash cycle. Appropriate valving arrangements are provided so as to permit a complete flushing of the mixing tank and associated conduits and hoses to assure that all of the concentrated detergent solution is removed from the system so that such solution is not reapplied to the wash load during the rinse portion of the wash cycle and also so that the entire recirculation system is clean at the end of the wash cycle.

Figure 1:
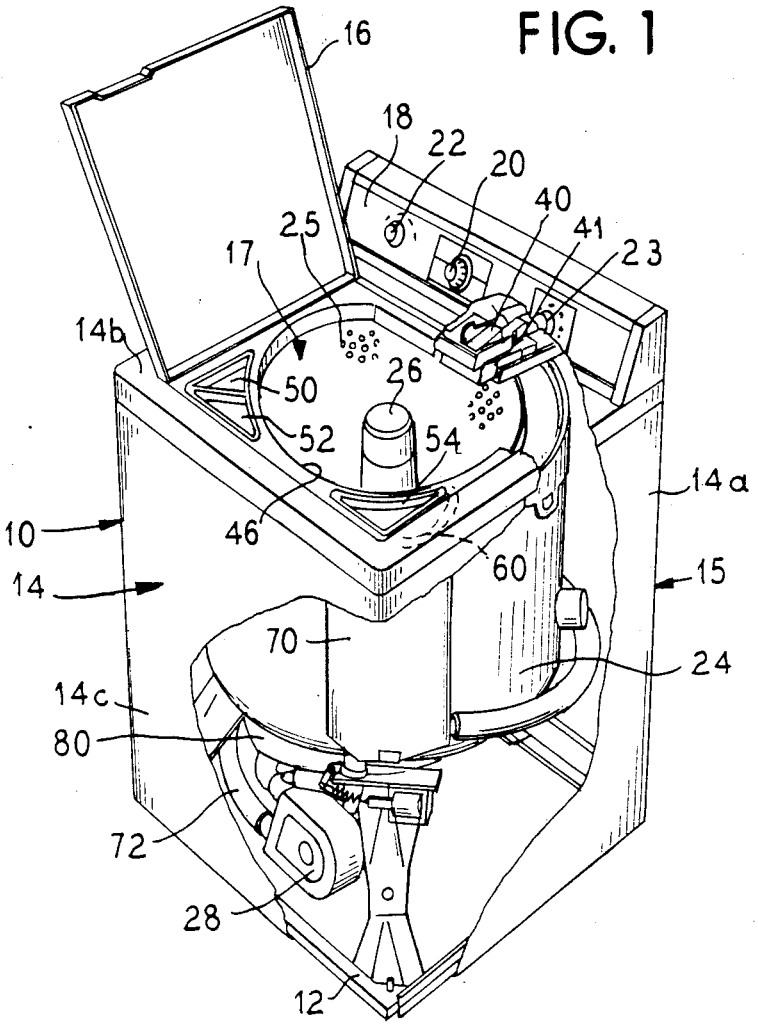
FIG. 1 is a perspective view of an automatic washer, partially cut away to illustrate various interior components.

FIG. **4*a* is a top view of the automatic washer of FIG. 1** with the lid removed.

FIG. **4*b*** is a top sectional view of the washer taken just below the level of the top panel.

Figure 5:
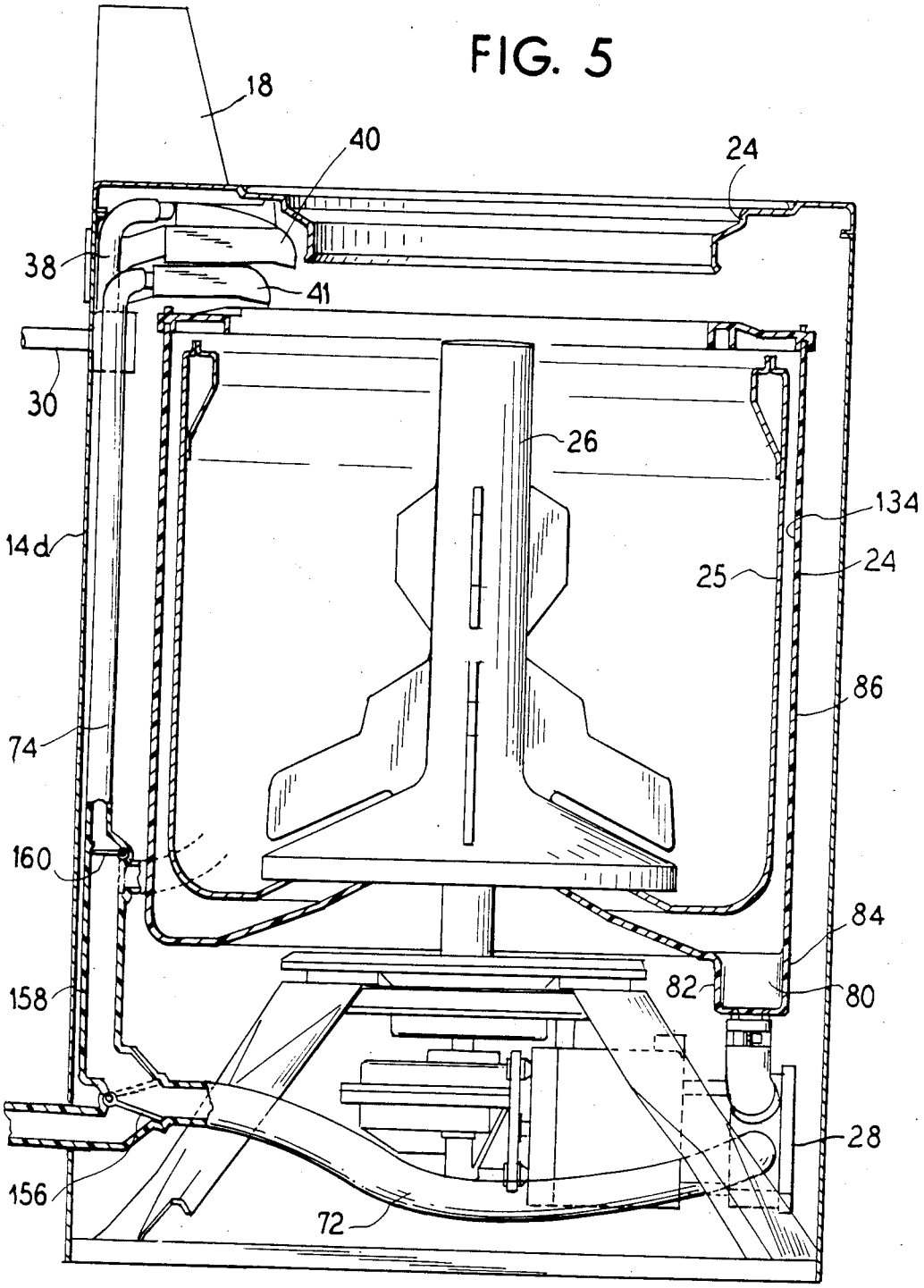

FIG. 5 is a side sectional view of the washer and illustrating a sectional view of the sump area.

Figure 6:
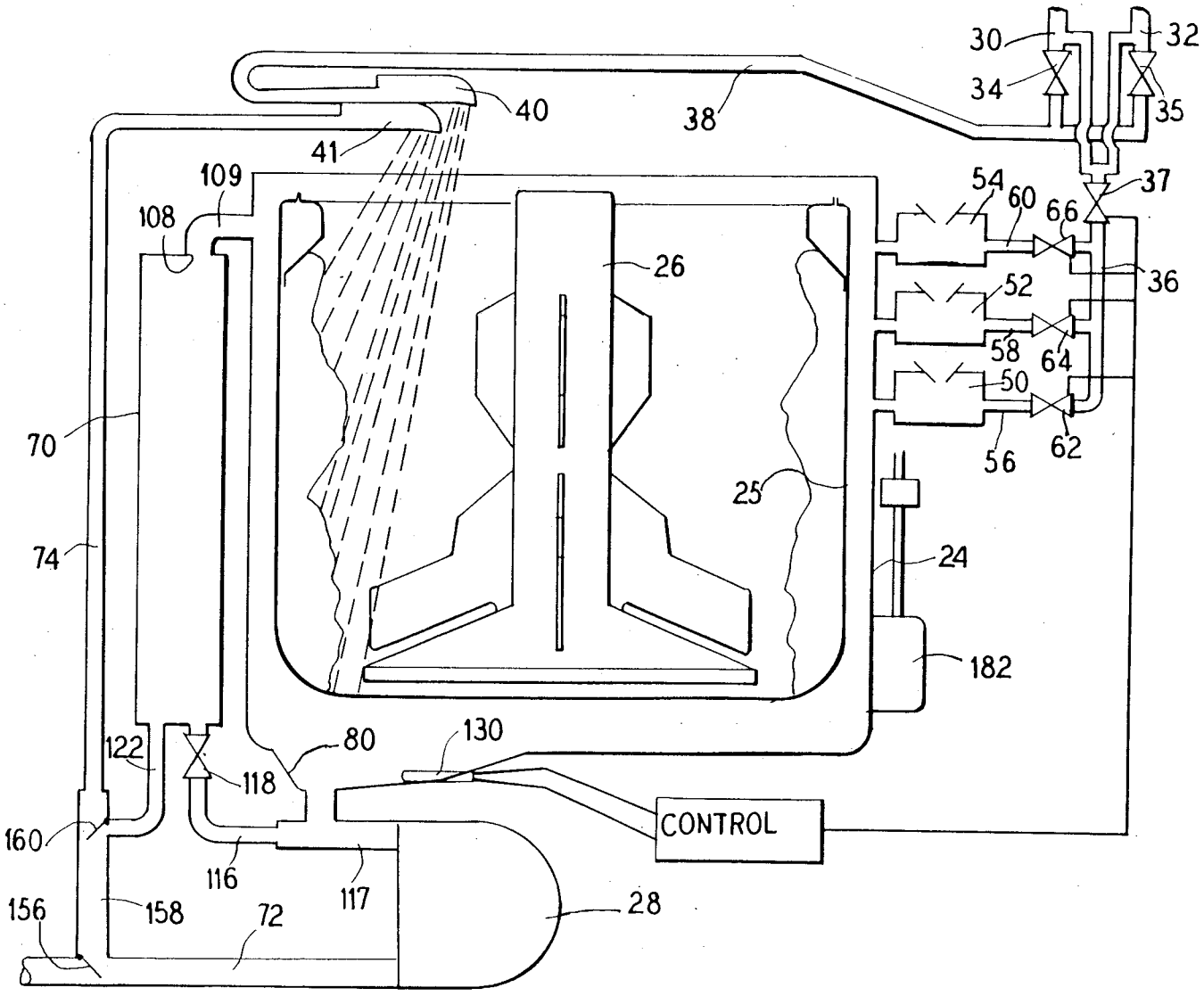

FIG. 6 is a schematic illustration of the fluid conduits and valves associated with the automatic washer.

Figure 7:
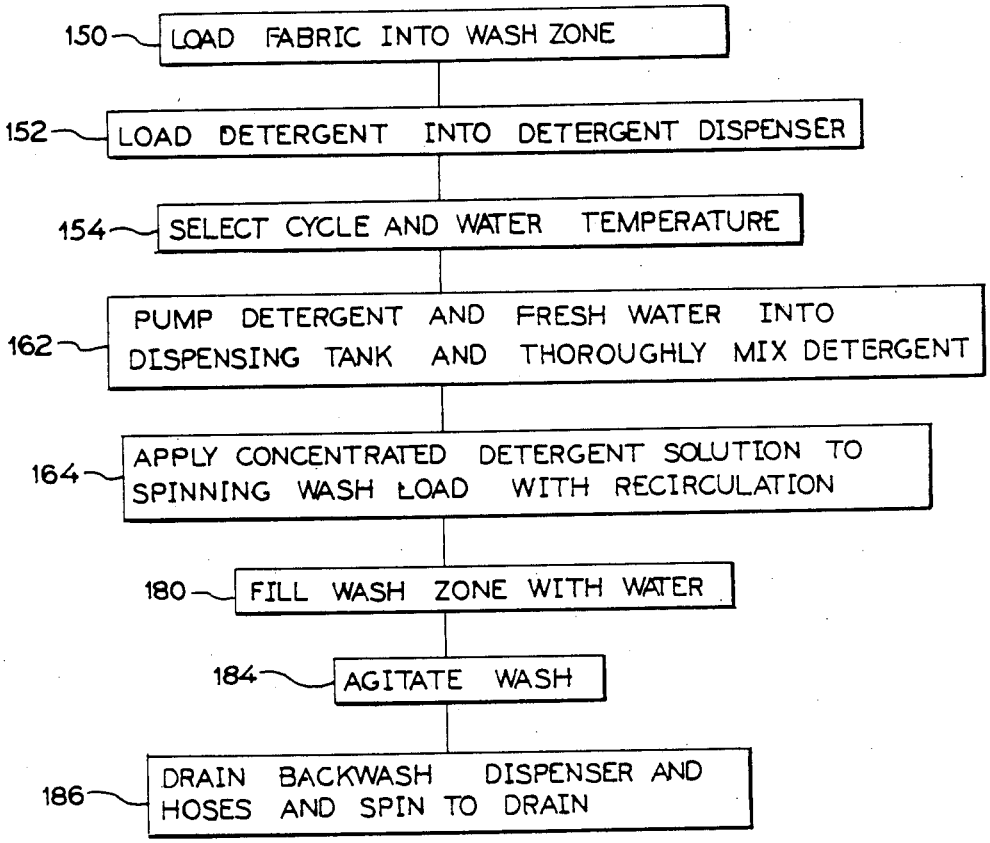

FIG. 7 is a flow chart diagram of the steps incorporated in the concentrated wash cycle.

FIG. **8*a*** is a side sectional view of the use of a pressure dome as a liquid level sensor in the sump area.

FIG. **8*b*** is a sectional view of the sump area illustrating an electrical probe liquid level sensor.

Figure 9:
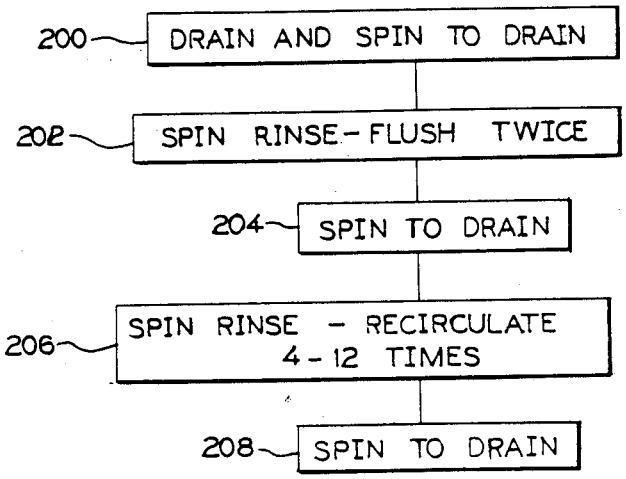

FIG. 9 is a flow chart diagram of an improved rinse cycle.

Figure 10:
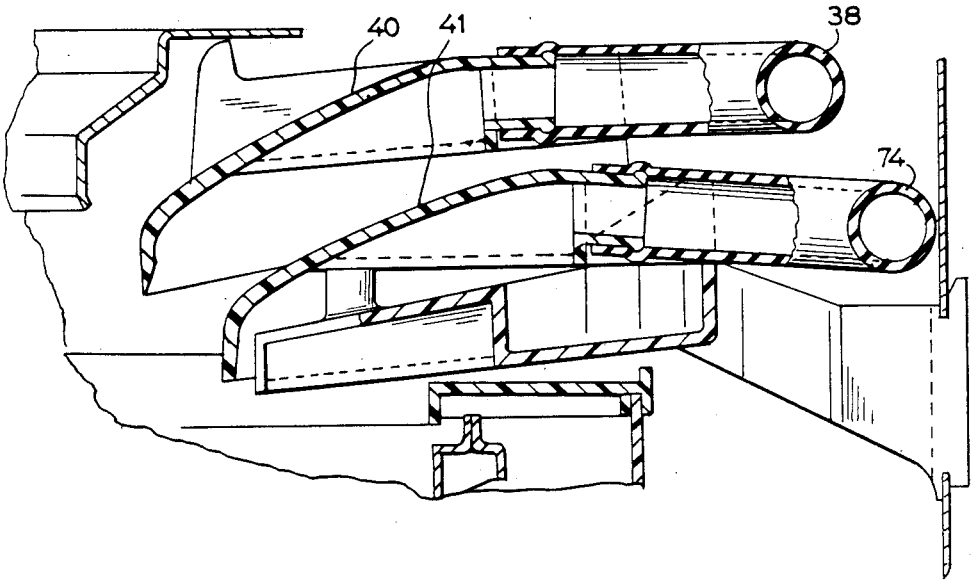

FIG. 10 is a side sectional view of the piggy back recirculating and fresh water inlet nozzles.

DESCRIPTION OF THE PREFERRED EMBODIMENTS

In FIG. 1, reference numeral 10 indicates generally a washing machine of the automatic type, i.e., a machine having a pre-settable sequential control means for operating a washer through a pre-selected program of automatic washing, rinsing and drying operations in which the present invention may be embodied. The machine 10 includes a frame 12 carrying vertical panels 14 forming the sides 14*a*, top 14*b*, front 14*c* and back 14*d* (FIG. 5) of the cabinet 15 for the washing machine 10. A hinged lid 16 is provided in the usual manner to provide access to the interior or treatment zone 17 of the washing machine 10. The washing machine 10 has a console 18 including a timer dial 20 or other timing mechanism and a temperature selector 22 as well as a cycle selector 23 and other selectors as desired.

Internally of the machine 10 described herein by way of exemplification, there is disposed an imperforate fluid containing tub 24 within which is a perforate spin basket 25 and a vertically disposed agitator 26, while a pump 28 is provided below the tub 24. Water is supplied to the imperforate tub 24 by hot and cold water supply lines 30 and 32 (FIG. 6), respectively, which are connected to respective hot and cold mixing valves 34 and 35 (FIG. 6). The mixing valves 34 and 35 in the illustrated production dispenser are connected to conduit 38. This triple dispenser also contains a by-pass around valves 34 and 35, which terminates in mixing valve 37 which is also part of the standard production dispenser. Mixing valve 37 connects to manifold conduit 36. Conduit 38 leads to a fresh water inlet housing or spray nozzle 40 mounted in piggy back style on top of a recirculating water inlet housing or spray nozzle 41 adjacent to the upper edge of the imperforate tub 24. The nozzles 40, 41, which are shown in greater detail in FIG. 10, may be of the type disclosed in U.S. Pat. No. 4,754,622 assigned to the assignee of the present application, or may be of any other type of spray nozzle. A single nozzle would be a preferred approach if U.L. and other certifying tests and standards could be satisfied.

Figure 4A:
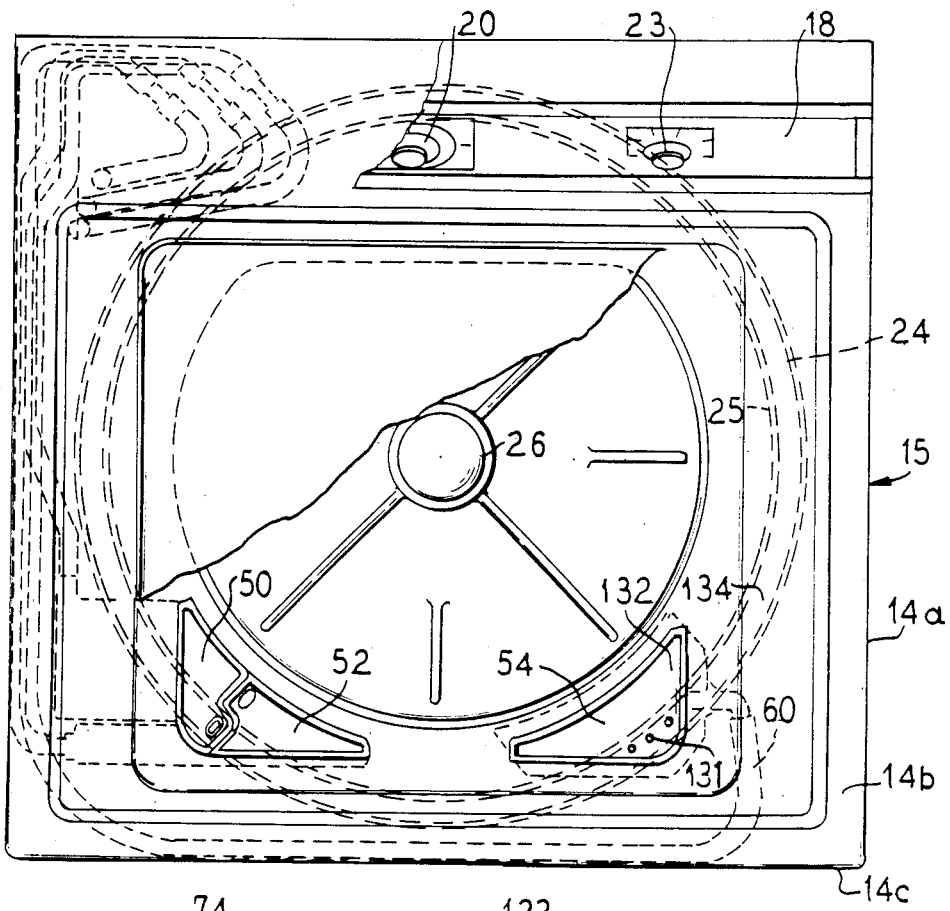

Surrounding a top opening 46 above the tub 24, just below the openable lid 16, there are a plurality of wash additive dispensers 50, 52 and 54. As seen in FIGS. 1 and 4A, these dispensers are accessible when the hinged lid 16 is in an open position. Dispensers 50 and 52 can be used for dispensing additives such as bleach or fabric softeners and dispenser 54 can be used to dispense detergent (either liquid or granular) into the wash load at the appropriate time in the automatic wash cycle. As shown schematically in FIG. 6, each of the dispensers, 50, 52 and 54 are supplied with liquid (generally fresh water or wash liquid) through a separate, dedicated conduit 56, 58, 60 respectively. Each of the conduits 56, 58 and 60 may be connected to a fluid source in a conventional manner, as by respective solenoid operated valves (62, 64, 66, FIG. 6), which contain built-in flow devices to give the same flow rate over wide ranges of inlet pressures, connect each conduit to the manifold conduit 36.

A mixing tank 70, as shown in FIG. 1, forms a zone for receiving and storing a concentrated solution of detergent during the wash cycle, and is used in some embodiments of the invention. As will be described in greater detail below, the mixing tank communicates at a top end with the wash tub and at a lower end communicates with the pump 28, a drain line or conduit 72 and a recirculating conduit 74. FIG. 1 also illustrates a collection zone in the form of a sump area 80 formed at a front portion of a bottom wall of the wash tub 24, which sump is shown in greater detail in FIGS. 2 and 5. In those figures it is seen that the particular sump 80 disclosed herein comprises an arcuate section of the tub 24 with a rear wall 82 forming a chord of the tub and a front wall 84 flush with a circumferential wall 86 of the tub.

Figure 2:
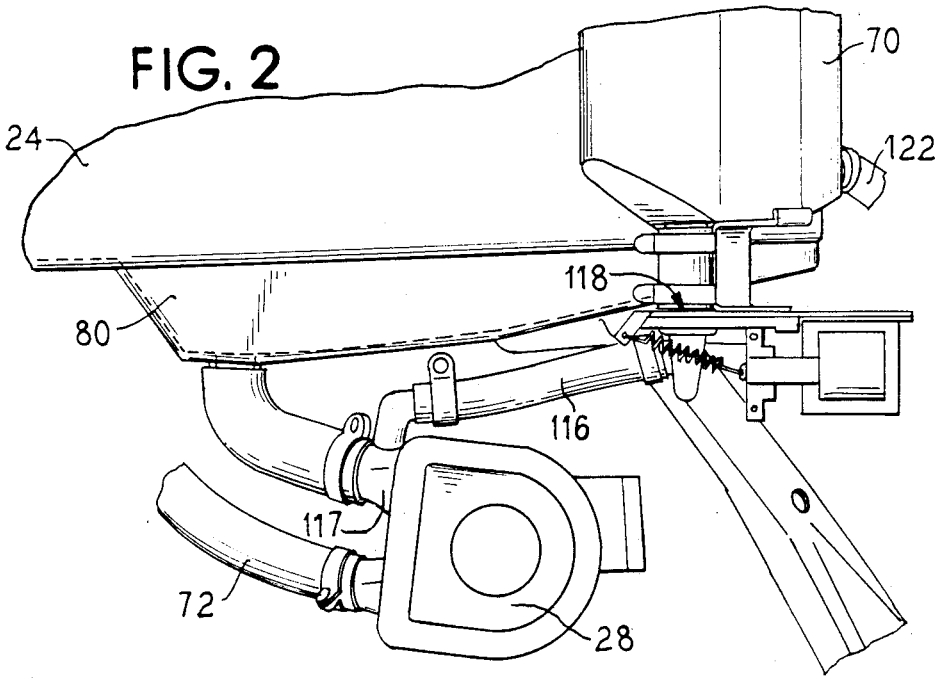
FIG. 2 is a front elevational view of the washer of FIG. 1 with the outer wrapper removed to illustrate the interior components.
Figure 3:
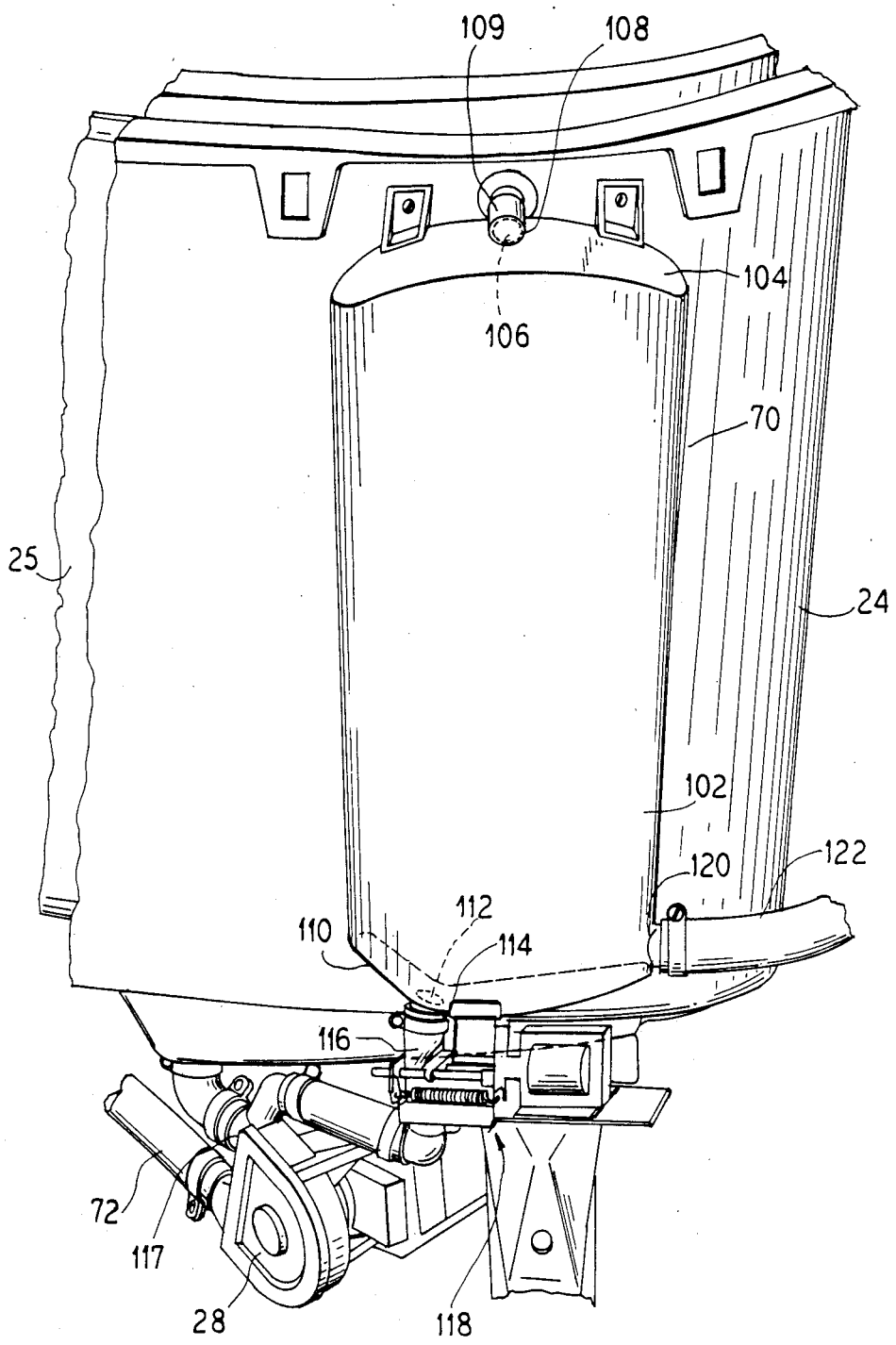
FIG. 3 is an enlarged partial side elevational view illustrating the dispensing tank and associated components.
Figure 4B:
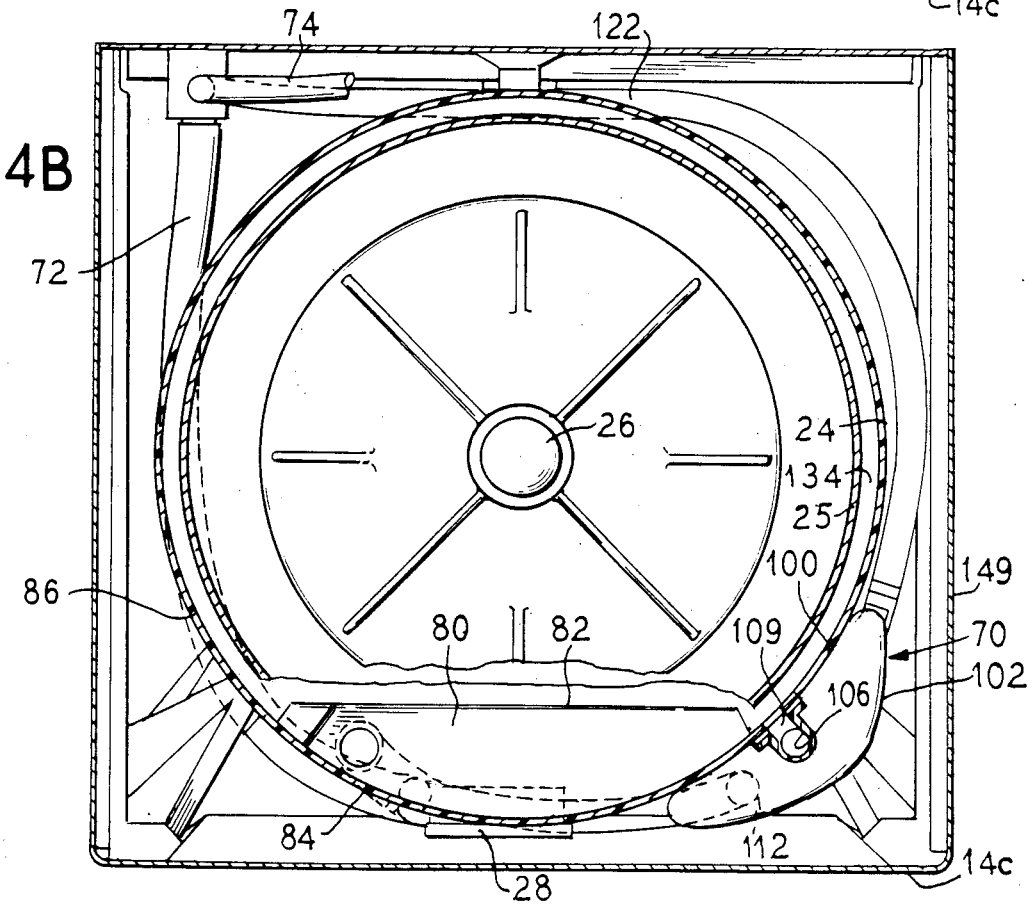

The mixing tank 70 is shown in greater detail in FIGS. 2, 3 and 4*b* where it seen that the tank 70 has an arcuate rear wall 100 conforming generally to the circumferential wall 86 of the tub and a somewhat more angular front wall 102 generally paralleling, but being spaced slightly inwardly of the right side wall 14*a* and the front wall 14*c* of the washer cabinet 14. Thus, the tank 70, which is secured to the exterior surface of the tub, fits within a normally non-utilized space within the front right corner of the washer cabinet 15.

The tank 70 has a generally curved, closed top wall 104 with a port 106 positioned at an apex 108 thereof, which port 106 communicates with the interior of the tub 24 through a short conduit 109. The tank 70 also has a curved lower wall 110 with a port 112 at a lowermost point 114. The port 112 communicates, through a conduit 116 with a suction inlet 117 of the pump 28. A selectively actuatable valve mechanism 118 provides selective communication through the passage represented by the conduit 116. Such a valve 118 can be of any of a number of valve types such as a solenoid actuated pinch valve, a flapper valve, or other type of controllable valve mechanism.

A third port 120 is provided through the front wall 102 of the tank 70, adjacent to the rear wall 100 and adjacent to the bottom wall 110. This port 120 communicates by means of a conduit 122 with the conduits 72 and 74 (FIG. 6) which, as described above, are associated with the pump 28, a drain 124 and the recirculating nozzle 41.

The detergent dispenser 54 has openings 131 through a bottom wall 132 thereof which communicate with a space 134 between the basket 25 and tub 24. As described above, the detergent dispenser 54 is provided with a supply of fresh water through conduit 60. The three way valve 37 (FIG. 6) is connected to conduit 60 so as to direct a flow of fresh water to either the detergent dispenser 54, the fresh water spray nozzle 40 directed to the interior of the wash basket 25, or both. Other types of detergent dispensers can, of course, be used with the present invention, including dispensers which hold more than a single charge of detergent and dispense a single charge for each wash cycle.

The sump 80 is provided to act as a collection zone for wash liquid contained within the tub 24, and is particularly useful in connection with a concentrated wash cycle as will be discussed below with respect to FIG. 7. In such a wash cycle, it is important to keep the collected wash liquid away from the spinning basket 25 to prevent an over sudsing of the wash liquid which is a concentrated detergent solution. Over sudsing of the liquid would result in a suds lock condition wherein a large buildup of suds would occur in the space 132 between the washer and basket, thus greatly increasing the drag on the spinning basket. The sump 80 thus provides a zone spaced a sufficient distance from the wash basket and having a sufficient capacity such that it can collect a sufficient amount of wash liquid therein to present a constant supply of wash liquid to the pump while preventing the collected wash liquid from coming in contact with the basket while in the collection zone during the recirculation portion of the concentrated wash cycle in order to avoid a suds lock condition.

Positioned within the sump is a liquid sensor means which may be in the form of a liquid level sensor 130. Such a sensor can be of a number of different types of sensors including a conductivity probe (FIG. 8B), a temperature thermistor (FIG. 6) or a pressure dome (FIG. 8A). Regardless of the sensor type, the liquid sensor must be able to detect either the presence of liquid detergent solution and/or the presence of suds within the sump. A sensor which detects the depth of liquid within the sump may also be utilized. When the sensor makes the required detection, it sends an appropriate signal to a control device 131, as is known in the art, to provide the appropriate control signals to operate the various valves as required at that portion of the wash cycle. As is described in greater detail below, the liquid sensor 130 is used to maintain a desired level of wash liquid within the sump 80 during the recirculating portion of the concentrated wash cycle.

Figure 8B:
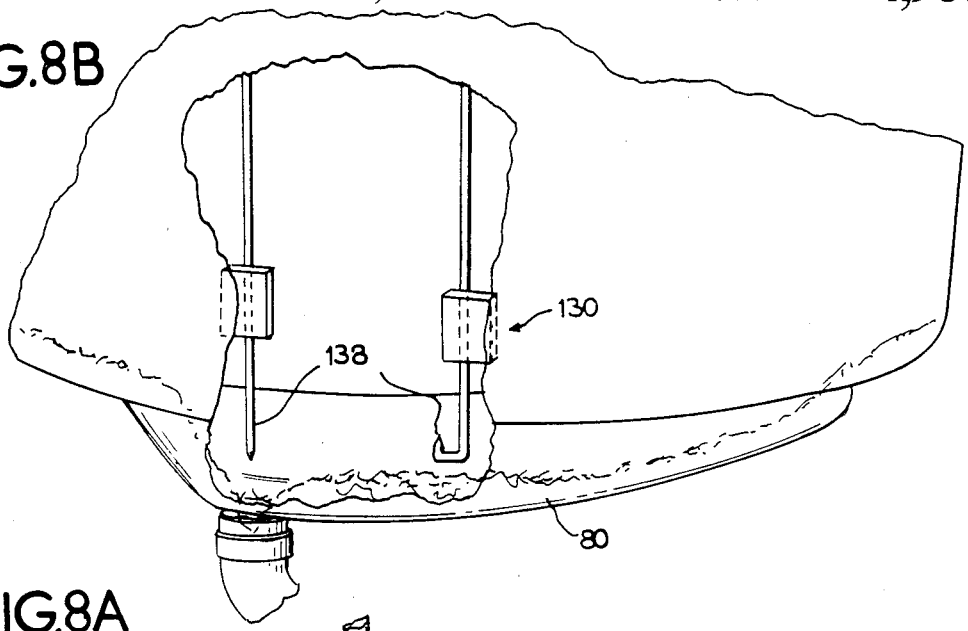
Figure 8A:
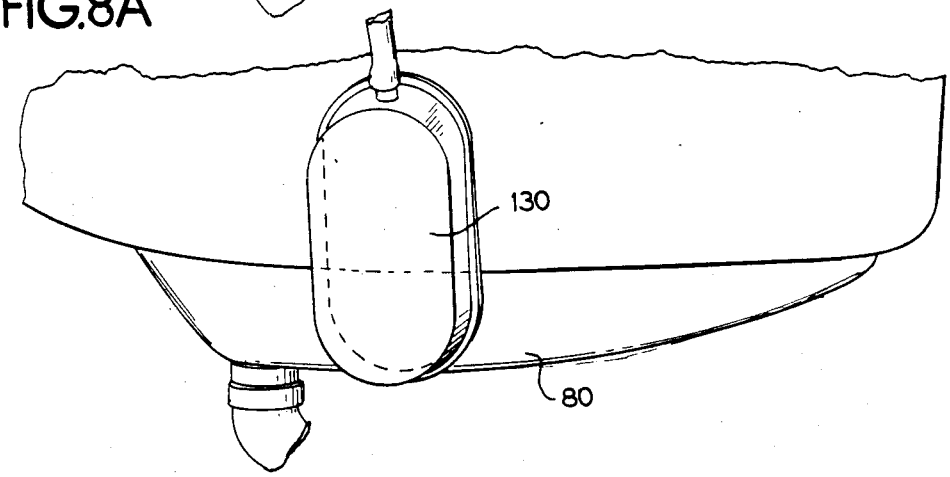

The probe sensor, shown in FIG. 8B, consists of two insulated stainless steel electrodes 138 having only the tips 140 exposed in the tub sump 80. When the detergent solution or suds level raises high enough to contact both electrodes, the low voltage circuit is completed indicating the sensor is satisfied.

A thermistor system, as generally indicated in FIG. 6, is also located in the sump 80 and is triggered when the water or suds level rises to the designated level, thus cooling the sensor element.

A pressure dome sensor, as shown in FIG. 8A, is similar to pressure domes normally utilized determining liquid level within an automatic washer tub, however it is the positioning of the dome in the tub sump, rather than on the upper side of the tub which is the major difference between its usage here and its traditional usage. If a pressure dome sensor is utilized, it would be beneficial for the sensor to have dual settings; one for spin/spray usage and a second for deep water fills as is discussed below. A pressure dome sensor may also be beneficial as a sensor to also detect an over sudsing condition. If the suds level is too high, then this sensor does not reset. The failure to reset is a means for terminating a spray/spin wash and/or for defaulting back to a traditional deep water rinse rather than spray rinses.

An improved wash cycle is provided by the present invention wherein a supply of fabrics to be washed is loaded into the wash zone 17 comprising the interior of the basket 25 as indicated by step 150 in FIG. 7. Also, a charge of detergent is placed within the detergent dispenser 54 as indicated by step 152 in FIG. 7. The amount of detergent placed into the dispenser is a normal amount that is used in a regular wash cycle for the size of the load being washed. The order of loading fabric and loading detergent may be interchanged without affecting the operation of the wash cycle.

Next, the user operates input controls 20, 22 and 23 on the console 18 so as to select the desired wash cycle, fabric type, water temperature and other load and cycle parameters as indicated by step 154 in FIG. 7.

The automatic wash cycle then begins and valves 34 and 35 are opened, as required by the selected temperature, causing water to flow into the washer. At the same time, the basket 25 begins rotating at a relatively slow spin speed, for example 40 rpm. Applicants have not determined an optimum spin speed, however, a low spin speed lessens the tendency for setting wrinkles and creating an over sudsing problem in this particular wash cycle. Spin speed significantly below 420 rpm are believed to offer significant improvements in wrinkle performance. However, in this system, the pump 28 is operated by the same motor that drives the basket 25 and when the motor rpm is reduced below that required to produce a 420 rpm rotation of the basket, there is reduced pumping and reduced soil removal during the recirculation portion of this wash cycle. Thus, in the system described herein, there is a performance trade off between soil removal and wrinkling.

As best seen in FIG. 6, the incoming fresh water is directed through valve 36 to flow only into the detergent dispenser 54 through conduit 60. The water entering the detergent dispenser 54 causes the detergent to be flushed through the openings 130 into the space 132 between the basket 25 and tub 24 and to flow down into the sump area 80 in the tub. The pump 28 is operating, as discussed, and thus the water and detergent solution which collects in the sump 80 is pumped through conduit 72 through a two way or three port valve 156 which is operated so as to seal off the exit to drain 124 and to open a passage to conduit 158. Two way or three port valve 160 is operated to seal off the connection to conduit 74 and to open the flow path to conduit 122 communicating with the mixing tank 70. Thus, the mixing tank fills with a concentrated solution of water and detergent and, depending upon the clothes load selected and the size of the washer, somewhere between 0.6 gallons and 1.2 gallons is admitted to the washer to at least partially fill the mixing tank 70. Valve 66 is then closed. Control valve 118 is then opened which causes the suction inlet 117 of the pump 28 to communicate through conduit 116 with the mixing tank 70 thus drawing the concentrated solution from the mixing tank, passing it through the pump 28 and returning it to the mixing tank through conduits 72, 158 and 122 to effect a thorough mixing of the detergent by recirculating the solution in a loop as indicated by step 162 in FIG. 7. The resulting mixture preferably has a detergent concentration of approximately 0.5% to 4%, as described in U.S. Pat. No. 4,784,666, incorporated herein by reference.

After a sufficient predetermined time has elapsed during which mixing occurs, control valve 118 is closed causing the mixing tank 70 to fill with the detergent solution.

Next, as indicated by step 164 in FIG. 7, the concentrated detergent solution is applied to the spinning fabric load with recirculation of the solution. The two way valve 160 is operated so as to cause a communication from conduit 72 leading from the pump 28 through conduit 158 to conduit 74 directed to the recirculating spray nozzle 41 positioned over the top opening of the basket 25. The control valve 118 is selectively opened and closed to meter predetermined amounts of concentrated solution into the interior of the wash basket. The liquid level sensor 130 is provided in the sump 80 to detect the presence of liquid collected in the sump. The monitoring of the sensor 130 begins concurrently with the opening of control valve 118.

Liquid level control is critical in the washer system chosen by Applicant to embody the present invention. Too much detergent solution added will create an over sudsing condition by allowing the spinning basket to contact detergent solution in the bottom of the tub. The preferred method of control is to maintain a minimum level of detergent solution in the sump through the use of the liquid level sensor 130. Modification of a standard tub, which results in a sump, permits the washer to function properly under a wide range of conditions, however, many washing conditions do not require the use of a tub sump.

A first, small incremental amount of concentrated solution is dispensed into the basket 25 and the liquid level sensor 130 is checked shortly thereafter to determine whether any liquid has returned to the sump. This is done in the first instance to determine whether there is any fabric within the wash basket. If there is no fabric, then all of the dispensed concentrated detergent solution will be returned to the sump 80 and the presence of that liquid will be detected by the sensor 130. An appropriate cycle ending process can be initiated if no fabric is detected.

However, if there is fabric in the wash basket, that fabric will absorb the concentrated detergent solution and therefore no solution will be present in the sump 80 to be detected by the sensor 130. Additional increments of solution are then dispensed by operation of control valve 118 until the sensor 130 detects a desired minimal level of liquid in the sump, thus satisfying the sensing requirement set for the sensor. A satisfied liquid level sensor indicates that the system does not require any additional detergent solution at this point in the cycle and the detergent tank valve 118 is then closed by the control device 131 to maintain the current level of detergent in the recirculating system. The control valve 118 is cycled on and off to dispense incremental amounts of concentrated detergent solution into the system. A time delay is provided following each additional dispensing to permit the newly dispensed solutions to flow to the sump 80. Satisfying the sensor may occur before all of the concentrated detergent has been dispensed from the mixing tank 70 or, it might require more liquid than is present in the mixing tank. If the latter is the case, then the inlet valves 34, 35 are operated to cause additional fresh water to be dispensed into the washer through the fresh water spray nozzle 40. Fresh water may also be dispensed through the detergent dispenser 54.

Once a sufficient amount of liquid has been dispensed onto the spinning clothes load, so as to keep a desired minimal level of water in the sump 80, control valve 118 is closed as well as control valves 34 and 35 and the solution collected in the sump 80 is continuously pumped in a recirculating loop through pump 28, conduit 72, two way valve 156, conduit 158, two way valve 160 and conduit 74 to the return spray nozzle 41 to be resprayed onto the spinning clothes load in the wash zone for continuous recirculation. The liquid level in the sump 80 is maintained at a minimal level so that the liquid does not rise to cause contact with the spinning basket 25, either through the liquid itself or any suds build up, so that a suds lock condition will not develop between the spinning basket 25 and the tub 24. If during the recirculating spin wash portion of the wash cycle the user introduces additional fabric materials to the wash zone, those materials will absorb some of the wash liquid and the sensor 130 will detect the reduced level of wash liquid in the sump 80. When this occurs, additional wash liquid, if any remains, will be admitted from the mixing tank, through conduit 116, into the recirculating loop passing through the wash zone. If no wash liquid remains in the mixing tank, fresh water will be admitted to the wash zone until the sensor 130 is again satisfied.

The recirculation of the concentrated detergent solution from the sump 80, through the pump 28, through conduits 72 and 74 and out spray nozzle 41 continues for a predetermined time in accordance with the wash cycle selected by the user and, optionally, the detected load size. For example, a cycle seeking maximum performance may recirculate the detergent solution through the fabric load for 14 minutes or more, while a permanent press cycle will attempt to minimize the length of the spinning.

Once the predetermined time has elapsed, the pump 28 ceases operation and the spinning of the basket 25 is also stopped. At that point, control valve 118 is opened to cause all remaining concentrated detergent solution in the tank 70 to drain into the tub 24. Next, two way valve 160 is operated to close conduit 122 and valves 34, 35 and 66 are operated to direct fresh water through the detergent dispenser 54 to rinse it out and then valve 37 is operated to direct fresh water through conduit 38 to the spray nozzles 40 so that in accordance with step 180 of FIG. 7, the wash zone 17 within the basket is filled with water. Fresh water is introduced into the wash basket to a normal fill level, thus reducing the detergent concentration within the wash basket to a normal concentration level. A standard liquid level detector 182, such as an air dome, the use of such a sensor is described in U.S. Pat. No. 4,697,293, assigned to the assignee of the present application is utilized to sense the level of liquid within the wash basket. As described above, if an air dome is utilized as the liquid level sensor 130 that air dome may also be utilized as the liquid level sensor 182 so long as the range of detection is sufficiently large as to accurately detect the minimal levels required of sensor 130 and the relatively maximum levels of a deep fill detected by sensor 182.

Once the wash basket has been filled to the appropriate level and the inlet valves have been closed, the next step, as indicated by step 184 on FIG. 7 is to drive the agitator 26 in an oscillatory manner relative to the basket in a normal manner as is well known in the art. Again, the length of time and type of such agitation is dependent upon the cycle selected by the user and, optionally, the amount of fabric within the basket 25. For example, high agitation of maximum time may be selected for maximum soil removal, while low agitation of minimum time may be selected for less fabric flexing when washing sweaters or wools. If bleach is being added, the valves 35 and 64 are opened for a predetermined time to flush the bleach container. Agitation continues following the addition of bleach for a specific time.

Upon termination of the agitation step, as indicated by step 186 in FIG. 7, the liquid within the wash tub 24 is caused to be directed to the drain by operation of the valve 156 opening conduit 172 to drain. After a relatively short period of time in which some of the wash liquid has been drained from the tub, valve 156 is operated so that the passage to drain is closed and valve 160 is operated so that the passage from conduit 158 to conduit 74 is closed, thus opening the passage to conduit 122 leading to the mixing tank 70. The wash liquid is thus pumped into the mixing tank to completely fill the mixing tank and to cause it to overflow through opening 108 and conduit 109 into the space 134 between the basket 25 and the tub 24 thereby back flushing the mixing tank to remove any remaining concentrated wash solution from the walls of the mixing tank and conduits. The two way valve 160 is also then operated to cause wash liquid to flow through conduit 74 and out through spray nozzle 41, again to flush out any concentrated detergent solution which remains on the walls of the conduit 74 and spray nozzle 41. Two way valve 156 is then operated to open the passage from conduit 72 to drain so that all of the wash liquid in the tub is removed. Then, the basket 25 begins to spin in order to extract out as much wash liquid as is possible from the fabric load within the basket 25 the extraction by spinning is accomplished at a spin speed and time specified by fabric and cycle type.

This draining and spin to drain series of steps is again represented in FIG. 9 at step 200 in that the drain and rinse portion of the wash cycle is useful, not only with respect to the concentrated wash cycle, but also is quite useful with a "standard" wash cycle as is used in virtually every vertical axis washing machine. FIG. 9 illustrates that the next step is to spray fresh water (of a predetermined quantity or for a predetermined time) through spray nozzle 40 onto the fabric load as it continues to rotate in the spinning basket 25. Since the fresh water spray is directed on the radially inward side of the fabric load, the spinning of the basket causes the fresh water to be forced outwardly, due to centrifugal force, carrying excess suds, scrud and wash liquid solution retained on the fabric load, basket, tub and sump. The liquid which is flung from the basket against the tub wall during this spinning operation is collected in the sump 80 and is pumped through pump 28 directly to drain. Spinning of the clothes load continues, even after the spray of fresh water from the spray nozzle 40 is terminated so as to pump all of the liquid possible from the clothes load directly to the drain. A second spray of fresh water (again of a predetermined amount or for a predetermined duration) from the nozzle 40 is directed to the spinning fabric load, and again the collected liquid flung from the basket against the tub wall is collected in the sump and is pumped directly to drain. If there is an excess of suds remaining in the washer at this point, as detected by sensor 130, the washer cycle defaults to a traditional deep water rinse. Such a sequence steps is illustrated at step 202 in FIG. 9.

Following the second such flushing spray rinse, the basket 25 continues to spin and the collected liquid continues to be pumped to drain as indicated by step 204. After a predetermined time period, the two way valve 156 is operated so as to close off the connection to drain and then fresh water is again supplied through the spray nozzle 40 against the spinning fabric load. The water dilutes detergent in the fabric as it passes through the load and basket. The excess liquid which is flung from the spinning basket 25 against the tub 24 is collected in the sump and is pumped through conduits 72, 158 and 74 to be recirculated through nozzle 41 onto the spinning fabric load. The dilute solution extracts additional detergent from the load with each pass. This recirculation continues for a predetermined time as indicated by step 206 and then at the conclusion of that predetermined time, the two way valve 156 is operated to open the passage to drain. The liquid which had been recirculated is then directed to drain as indicated by step 208. After a predetermined time, the two way valve 156 is again operated causing the passage to drain to close and another spray of fresh water from nozzle 40 is directed against the spinning fabric load. Again this liquid is collected in the sump 80 and is recirculated to the spinning fabric load through the pump, conduits 72, 158 and 74 and spray nozzle 41. This sequence of spinning and recirculating spray rinses followed by a spin to drain step is repeated four to twelve times, depending on the cycle selected by the user and, optionally, the fabric load. It has been determined by Applicants that the use of two flush spin rinses as indicated by step 202 and six recirculation spin rinses as indicated by step 206 results in a level of detergent removal from the fabric load equivalent to that presently obtained in the standard deep fill and rinse cycles commonly employed by commercial vertical axis washing machines. However, the flush spin rinses and recirculation spin rinses use considerably less water than the conventional deep fill rinse. Thus, a considerable savings in water and energy (particularly if the rinse water is heated) is obtained. Further, by utilizing additional recirculating spin rinses, an improved level of detergent removal of the fabric load can be achieved.

If fabric softener is to be applied to the clothes load, during the final recirculating spray rinse, fresh water is sprayed onto the spinning clothes load unit sensor 130 is satisfied. Once that occurs, valves 35 and 62 are opened to flush all of the fabric softener from the dispenser 50 into the tub. Valves 35 and 62 are then closed and the softener is mixed with the water being recirculated through the fabric load. This solution is recirculated through the load for a predetermined time and then the valve to drain is opened and the final spin to drain step is completed.

While a preferred wash cycle has been described for use with the present invention, it should be understood that modifications to the wash and rinse cycle may be made without departing from the present invention. For example, although a combination of flush and recirculating rinses has been described, the present invention may also be employed for use in a wash cycle which utilizes flush only type spray rinses or recirculation only spray rinses or traditional deep rinses. Other modifications to the wash cycle will be apparent to those of ordinary skill in the art.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. An automatic washing machine comprising
an imperforate wash tub;
a wash basket positioned within said wash tub defining a wash zone;
a fresh water inlet; and
a recirculation system comprising:
a collection zone for receiving wash liquid from said wash zone and being spaced below said wash basket;
a pump having a suction inlet communicating via a first fluid conduit with said collection zone;
a recirculation nozzle selectively communicating with a discharge outlet of said pump via a second fluid conduit, said nozzle being positioned to direct wash fluid into said wash zone;

a mixing zone for receiving and storing a supply of detergent and fresh water, said mixing zone selectively communicating with said suction inlet via a third fluid conduit and selectively communicating with a discharge outlet of said pump via a fourth fluid conduit;

sensing means associated with said collection zone for sensing the presence of wash liquid within said collection zone; and control means for admitting wash liquid to said wash zone in response to a predetermined condition of said sensing means.

2. An automatic washing machine according to claim 1, wherein said collection zone comprises a sump area in a bottom wall of said wash tub.

3. An automatic washing machine according to claim 1, wherein said collection zone is spaced a sufficient distance from said wash basket and has a sufficient capacity such that it can collect a sufficient amount of wash liquid therein to present a constant supply of wash liquid to said pump while preventing said collected wash liquid from coming in contact with said basket while in said collection zone.

4. An automatic washing machine according to claim 1, wherein said selective communication between said nozzle and said pump comprises a valve positioned in said second fluid conduit operated by said control means.

5. An automatic washing machine according to claim 1, wherein said mixing zone comprises a mixing tank secured to an exterior surface of said tub.

6. A fluid recirculation system for an automatic washer comprising:

a collection zone for wash liquid;

a pump having a suction inlet communicating via a first fluid conduit with said collection zone;

a recirculation nozzle selectively communicating with a discharge outlet of said pump via a second fluid conduit;

a mixing zone for receiving a supply of detergent and fresh water, said mixing zone having an outlet selectively communicating with said suction inlet via a third fluid conduit and an inlet selectively communicating with a discharge outlet of said pump via a fourth fluid conduit; and sensing means associated with said collection zone for sensing the presence of wash liquid within said collection zone; and control means for admitting wash liquid to said wash zone in response to a predetermined condition of said sensing means.

7. A fluid recirculation system for an automatic washer according to claim 6, wherein said sensing means comprises a pair of conductivity probes, each comprising an electrode with a tip exposed in said collection zone to detect the presence of wash liquid by measuring the conductivity of the path between said two electrode tips.

8. A fluid recirculation system for an automatic washer according to claim 6, wherein said sensing means comprises a pressure dome sensor positioned in said collection zone to detect the presence of wash liquid by measuring the pressure applied against said pressure dome.

9. A fluid recirculation system for an automatic washer according to claim 6, wherein said sensing means comprises a thermistor system located in said collection zone to detect the presence of wash liquid by sensing the temperature of a sensor element.

10. An automatic washing machine comprising an imperforate wash tub;

a wash basket positioned within said wash tub defining a wash zone; and a recirculation system having at least two recirculation loops comprising:

a collection zone for wash liquid spaced below said wash basket and communicating with said wash zone;

a pump having a suction inlet communicating via a first fluid conduit with said collection zone;

a recirculation nozzle selectively communicating with a discharge outlet of said pump via a second fluid conduit, said nozzle being positioned to direct wash fluid into said wash zone;

a mixing zone for receiving a supply of detergent and fresh water, said mixing zone selectively communicating with said suction inlet via a third fluid conduit and selectively communicating with a discharge outlet of said pump via a fourth fluid conduit;

said collection zone, pump, recirculation nozzle and first and second fluid conduits comprising a first loop of said recirculation system passing through said wash zone, and said mixing zone, pump and third and fourth fluid conduits comprising a second loop of said recirculation system entirely outside of said wash zone.

11. An automatic washing machine according to claim 10, wherein said mixing zone can selectively communicate with said first loop via said third fluid conduit to admit wash fluid from said mixing zone into said first loop.

12. An automatic washing machine according to claim 10, wherein said collection zone comprises a sump area in a bottom wall of said wash tub.

13. An automatic washing machine according to claim 10, wherein said collection zone is spaced a sufficient distance from said wash basket and has a sufficient capacity such that it can collect a sufficient amount of wash liquid therein to present a constant supply of wash liquid to said pump while preventing said collected wash liquid from coming in contact with said basket while in said collection zone.

14. An automatic washing machine according to claim 10, wherein said selective communication between said nozzle and said pump comprises a valve positioned in said second fluid conduit operated by said control means.

15. An automatic washing machine according to claim 10, further including a sensing means associated with said collection zone for sensing the presence of wash liquid within said collection zone and control means for admitting wash liquid to said wash zone in response to a predetermined condition of said sensing means.

* * * * *